US005077887A

United States Patent [19]

Holloway

[11] Patent Number: 5,077,887

[45] Date of Patent: Jan. 7, 1992

[54] METHOD FOR PRODUCING GRIPPER MEANS FOR STRETCHER LEVELER APPARATUS

[76] Inventor: Bertram A. Holloway, 150 Karen Dr., Washington, Pa. 15301

[21] Appl. No.: 575,167

[22] Filed: Aug. 29, 1990

Related U.S. Application Data

[60] Division of Ser. No. 376,387, Jul. 6, 1989, Pat. No. 4,982,593, which is a continuation-in-part of Ser. No. 819,028, Jan. 15, 1986, abandoned, which is a continuation-in-part of Ser. No. 485,275, Apr. 15, 1983, abandoned.

[51] Int. Cl.[5] ..... B23P 15/00; B32B 33/00; B05D 7/24; B29C 39/42

[52] U.S. Cl. ..... 29/458; 29/525.1; 264/265; 264/274; 427/409; 76/101.1

[58] Field of Search ..... 76/101.1; 264/265, 274, 264/259, 135; 427/409; 81/418, 421–423, 424.5, 900, 186; 269/286, 274, 275; 72/302; 29/458, 525.1

[56] References Cited

U.S. PATENT DOCUMENTS

| | | | |
|---|---|---|---|
| 2,519,107 | 8/1950 | Brown | 269/275 |
| 2,594,684 | 4/1952 | Rothe | 269/286 |
| 2,766,649 | 10/1956 | Labry | 269/274 |
| 2,809,130 | 10/1957 | Rappaport | 156/310 |
| 2,980,046 | 4/1961 | McGregor | 72/350 |
| 3,047,934 | 8/1962 | Magner | 264/265 |
| 3,077,658 | 2/1963 | Wharton | 264/265 |
| 3,290,199 | 12/1966 | Willhoite | 264/135 |
| 3,322,423 | 5/1967 | Popow | 269/274 |
| 3,515,139 | 6/1970 | Mallina | 81/421 |
| 4,036,668 | 7/1977 | Brandon | 264/265 |
| 4,114,245 | 9/1978 | Bainard | 264/135 |
| 4,198,037 | 4/1980 | Anderson | 264/265 |
| 4,258,089 | 3/1981 | Anderson | 29/132 |

FOREIGN PATENT DOCUMENTS

| | | | |
|---|---|---|---|
| 16193 | 12/1966 | Japan | 264/135 |
| 160133 | 9/1983 | Japan | 264/265 |
| 168501 | 7/1934 | Switzerland | 72/302 |

*Primary Examiner*—Daniel C. Crane
*Attorney, Agent, or Firm*—Ansel M. Schwartz

[57] ABSTRACT

A method for producing a stretcher leveler gripper means for use in a stretcher leveler apparatus in which the surface for engagement with the metal to be stretched comprises a smooth polymeric material most desirably of a thermoset polyurethane.

16 Claims, 1 Drawing Sheet

METHOD FOR PRODUCING GRIPPER MEANS FOR STRETCHER LEVELER APPARATUS

RELATED PATENTS

This application is a divisional of U.S. patent application No. 07/376,387, filed July 6, 1989, now U.S. Pat. No. 4,982,593, issued Jan. 8, 1991, which is a continuation-in-part of co-pending U.S. patent application 06/819,028 filed Jan. 15, 1986, which in turn is a continuation-in-part of abandoned U.S. patent application 06/485,275 filed April 15, 1983.

FIELD OF THE INVENTION

The present invention relates to an improved gripper means for use with a stretcher leveler device, in particular, to improved grippers which eliminate disfigurement of the surface of steel sheets undergoing stretcher leveling.

BACKGROUND OF THE INVENTION

The two primary methods of providing straight or flattened steel strip or sheet are roller leveling and stretcher leveling. Roller leveling is typically performed in a rolling machine consisting of two sets of rolls. A top and bottom set of several small diameter horizontal rows each are mounted in a housing so that the associated top and bottom rolls are offset from each other. A steel sheet or strip passing through the leveler is flexed up and down alternately between the offset rolls such that the amount of flexing decreases as the sheet travels toward the exit end of the roller leveler. The rolls nearest the exit end are designed to perform the basic straightening operation. The advantage of roller leveling is that long lengths of sheet or strip may be leveled or flattened with minimum surface disfigurement. However, roller leveling does not impart the same degree of flatness to the sheet or a pair of opposing jaws actuated by hydraulic or pneumatic means. Typically, sheet or strip is elongated between one and three per cent so that the elastic limit of the steel is exceeded to produce permanent elongation. There are numerous types of stretcher leveler devices including those which can handle large coils of rolled strip. However, in all stretcher levelers the jaws of the device include gripping means to securely grip the opposing ends of the sheet which is to be stretched. These gripper means typically comprise a flat elongated engagement member shaving a length slightly greater than the width of the sheet or strip to be stretched. The surface of the engagement member which is adapted to engage or grip the surface of the sheet or strip to hold it against movement during elongation is very rough, normally grooved, knurled or serrated. Consequently, in virtually all such stretcher leveler devices the gripper means bite into the metal and disfigure the surface of the sheet. Traditionally, the disfigured portion of the sheet or strip is marked and subsequently cut off as scrap. For example, in a coil 2125 feet in length, approximately 162" are lost in scrap.

The disfigurement of the metal results in substantial economic loss because that metal is normally discarded as waste. Moreover, when coils of rolled strips are stretched in sequential stretching, the gripper disfigurement marks must be indicated and cut from the coil. Thus, the maximum length of strip or sheet which could be leveled is the distance between the grippers.

It is, therefore, an object of the present invention to provide a gripper means for use on stretcher leveler devices which affords adequate gripping capabilities, but which eliminates surface disfigurement on the sheet or strip stretched. A further object of the present invention is to provide gripper means which will enable stretching of any length of strip by successive stretching operations such that an entire coil of rolled strip, in effect, can be stretcher leveled without the need to remove the portions of metal engaged by the gripper.

SUMMARY OF THE INVENTION

The present invention comprises a novel gripper means which overcomes the disadvantages of the prior art grippers by having a very smooth engagement surface formed from a high density polymeric material. The engagement surface is preferably made from a cast high density thermoset polyurethane. The preferred urethane is Adiprene® (manufactured by Mobay Chemical Co.) which has a durometer of between 60 and 95 on the "D" scale and 75-95 on the "A" scale. The polymeric surface may be integrally bonded to a metal backing gripper plate machined to adapt directly to the stretcher leveler device.

While polyurethane is the preferred material, other polymeric urethanes or materials having the same physical characteristics may be used. For example, it has been found that high density polyethylene does not provide satisfactory results. Accordingly, to achieve the significant benefits of the present invention, the preferred polyurethane should be used. With respect to secondary evidence of patentability, Dr. Watson and Dr. Hershberger both at the time employed by the NASA Industrial Applications Center, University of Pittsburgh, and who assisted in the design of the adhesive for and the material of the tiles on the Space Shuttle, attempted in the latter part of 1982 to solve the problem of marring of metal by the stretcher leveler. They determined from their analysis of the facts that polyethylene was the material of choice for the gripping surface. However, the polyethylene completely failed. The metal to be gripped slipped through the gripping surface and stretching could not be accomplished.

Other advantages of the present invention will become apparent from a perusal of the following detailed description of the presently preferred embodiment taken in connection with the accompanying drawings.

PRESENTLY PREFERRED EMBODIMENT

Figure 1:
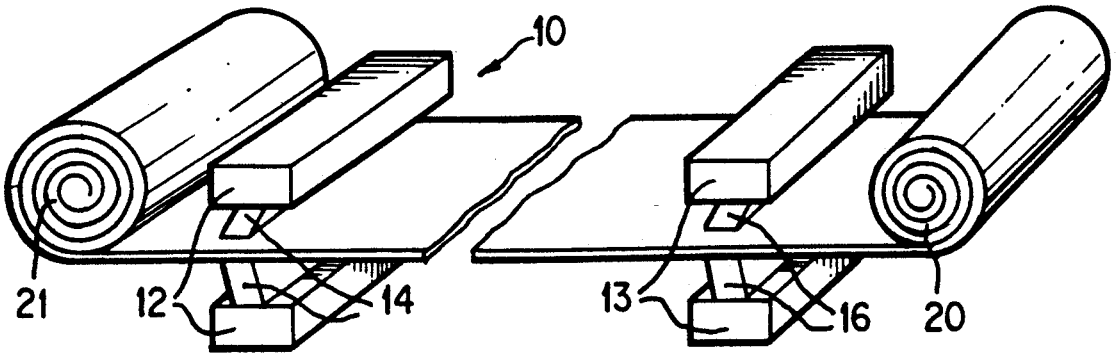
FIG. 1 is a diagrammatic illustration of a conventional stretcher leveler used to flatten coils of rolled steel strip.

With respect to FIG. 1, an illustrative function diagrammatic view of stretcher leveler 10 is shown having a pair of opposing jaws 12 and 13, each pair of jaws including a pair of gripper means 14 and 16, respectively. Jaws 12 and 13 may be actuated (opened or closed) in the vertical direction by means of hydraulic or pneumatic pistons or other actuating means, not shown. As shown in FIG. 1, a coil strip 20 of metal, such as steel or titanium, is positioned to run through stretcher means 10 for successive stretcher operations between the jaws 12 and 13 where it is taken upon take-up coil 21. Where the distance between jaws 12 and 13 is great, for example, 80 feet or more, the strip is supported by a plurality of rolls, not shown, or other support means.

In typical operation, strip 20 is positioned between jaws 12 and 13 which are hydraulically or pneumatically controlled to engage by means of gripper pairs 14 and 16 and surface of strip 20. Once a firm contact is made with the strip, hydraulic means (not shown) actuates a pair of jaws to move in opposite direction from the other pair to elongate the strip 20 between jaw pairs 12 and 13. Once elongation has been achieved, jaws pairs 12 and 13 are opened and the stretched portion of strip is incrementally taken up on take-up coil 21 and the next stretching operation commenced. By successive stretching operations, entire coil 20 can be stretcher leveled.

In the prior art, gripper means 14 and 16 precluded a continuously stretcher leveled coil without substantial surface disfigurement. In addition, it is a common requirement that each surface blemish be marked so that the end user of coil 21 can readily determine the location of each blemish. Such requirement necessitates either the use of automatic marking machines or manual markers; both of which add to the cost of stretcher levelling. However, in accordance with the present invention entire take-up coil 21 is stretcher leveled and unblemished either by surface disfigurement or indicator marks.

Figure 2:
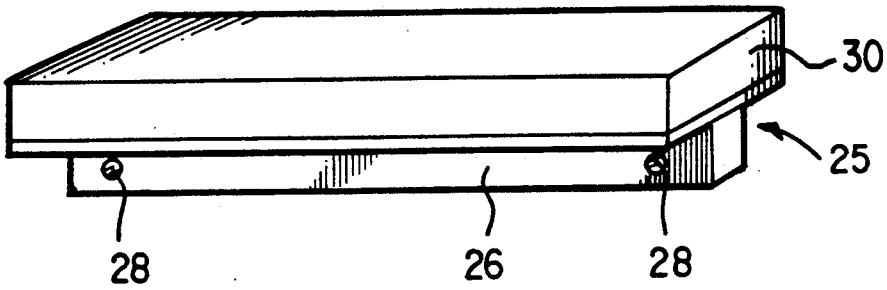
FIG. 2 is a perspective view of a gripper means having an engagement surface in accordance with the present invention.
Figure 3:
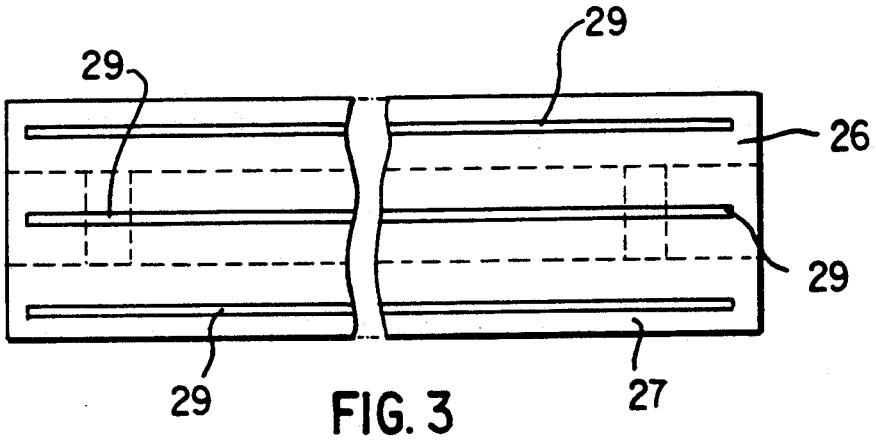
FIG. 3 is a plan view of a gripper plate surface.
Figure 4:
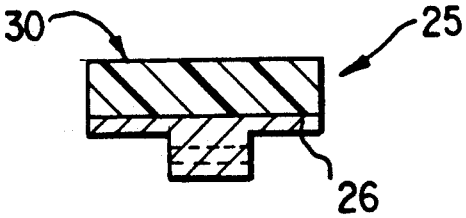
FIG. 4 is a sectional elevation of gripper means in accordance with the present invention.

Referring to FIGS. 2–4, the gripper means 25 of the present invention comprises a gripper support pad or member 26 adapted to mount on stretcher leveler 10 for use in gripper pairs 14 and 16. Preferably, support member 26 is made of 4140 high tempered carbon. Gripper support member 26 includes support surface 27 to which polymeric gripping surface 30 is secured. The surface 27 can have grooves 29 which are preferably disposed in the surface such that they are perpendicular to the direction metal is stretched by the stretcher leveler. The grooves 29 present a greater surface area of the support surface 27 to which the gripping surface 30 can anchor or bond during casting. In a practical embodiment, support pad or member 26 is about 51" long and 5" wide. The grooves are preferably 1/16 of an inch in depth, 1/16 of an inch wide, and approximately 49 inches long. Support pad or member 26 also includes openings 28 for mounting and operatively anchoring the member 26 on a stretcher leveler.

Each gripper pair 14 and 16 requires two gripper means 25, one on top and one on the bottom. The gripping surface covers the support surface and is between 1/16 of an inch and 2 inches thick and preferably ⅛ of an inch thick. If the gripping surface 30 is too thick, the gripping surface 30 breaks down faster over time during operation of the stretcher leveler. If it is too thin, then the metal is not protected from the steel support member 26 and is marred. Optimally, the thickness of the gripping surface 30 is such that no marring to the metal occurs and a minimal amount of bending is experienced by the gripping surface so it lasts longer.

Preferably, gripping surface 30 is a cast thermoset polyurethane such as Adiprene® (mfd. by Mobay Chemical Co.) which combines the qualities of both plastic and rubber. Gripping surface 30 is preferably cast, in situ, on support pad or member 26 at a temperature of about 200° F. Immediately prior to casting, however, it is desirable to thoroughly clean surface 27, such as by sand blasting, and to apply an adhesive such as a thixon based adhesive (e.g., 403/404 or 409 type adhesive) to increase the binding strength of the member 26 with the gripping surface 30. The edges of the gripper surface that are on the metal contact side thereof are preferably rounded.

Preferably, the physical properties of cast gripping surface 30 are:

| ASTM D412 | Tensile Modular-PSI |
|---|---|
| @ 50% elongation | 750 |
| @ 100% elongation | 2000 |
| @ 300% elongation | 4000 |
| @ break | 9000 |
| Compression modular at 25% elongation deflection, shape factor 1.0 | 8000 |
| % elongation at break (ASTM D412) = | 265 |
| Abrasive index (%) (ASTM P1630) = | 435 |

Essentially, the gripping surface 30 is preferably made of a material strong enough not to break down or tear away from the support surface under an applied force up to 250,000 pounds. The gripping surface must also have a coefficient of friction great enough to prevent slippage of it with respect to the metal-1 being stretched during operation of the stretcher leveler. Additionally, the gripping surface must not damage the metal that it grips. Preferably, the material has a diameter of 90.

Gripper means 25 in accordance with the present invention have been tested by applicant on its PM 84 stretcher leveler having a width up to 52" for running 48" stainless steel coils. The stretcher leveler can be adjusted to stretch sheet a minimum of only 180° in length of material between the jaws or up to 80' in length. The jaws are pneumaticly actuated and the actual force used to elongate the strip is applied by hydraulic pistons applying up to 250,000 pounds of force. Generally, elongation of 00.4% to 1.6% is achieved.

Gripper means 25 in accordance with the invention generally last 2,000 or more stretcher levelings. Moreover, it has been found that it is desirable that the width of gripping surface 30 be from 2" to 8", and preferably about 5" in width. However, a width as small as ¾" has been successfully used in a larger stretcher leveler.

Because there is no marring of the surface of the stretcher leveled strip, no material has to be cut out resulting in a saving of up to 5% of the metal.

A particularly suitable polymeric material for forming the cast gripper surface (and also its integral support pad or member 26) as described in relation to FIG. 4, is adiprene 410 liquid resin. In the embodiment of FIG. 1 above, the liquid polymeric is to be poured upon the prepared carbon steel support surface 27 and then is cured in situ to form the cast rigid gripping surface 30. It is preferable, however, to precoat the steel surface 27 with thixon (R) adhesive as a base, before the pour application of the preferred polyurethane resin. This will ensure the cast gripping surface's adhesion to the support pad or member 26, despite the massive shearing pressure that the gripper jaws will undergo while up to 250 tons of tensile stress are repetitively placed upon the extended coil length to achieve the conventional stretcher leveler process, required in selective steel sheet applications.

The casting, in situ, on the support member 26 preferably occurs in a vacuum or as close to a vacuum as possible. The method of casting is preferably accomplished by first evacuating a chamber having the support member 26. Then the polymeric material is heated until it liquifies (200° F. for polyurethane) and poured on the support surface 27 of the support member 26. The liquid polymeric material is allowed to solidify and form the gripping surface 30. During this entire operation, the chamber is evacuated to minimize the potential for bubbles forming in the gripping surface 30. Any bubbles in the gripping surface 30 could weaken the gripping surface or allow the jaws to marr the metal along a deformity in the gripping surface where a bubble has caused an opening in the surface.

The economy effected by the present invention can be delineated by describing the experience with an average gauge (chief thickness) coil being first finished and then cut-up in a plant setting to produce 10 foot long cut sheets for shipping. The coil precursor is 0.048 inches gauge, 48 inches in width, and would weigh an average of 8 pounds per linear foot of coil length. By preclusion of the occurring of the prior art permanent gripping indentations, about $1.00 per pound of steel to save from scrappage. This equates to $4.00 per elongation for an 80 foot section of coil. Since the average coil has 2125 linear feet, this would approximate 27 stretches, for the average length coil, or a savings in reduced scrappage of about $108.00 per coil being elongated, using the gripping means of the present invention. This is the corollary of the increased usable length of 162 inches per coil (circa 15 feet). Also being obviated is the prior scrappage of the uneven length short sheets (those falling under the preset 10 foot sheet), which heretofore have occurred at the beginning and end of each processable coil.

The final gain is in an opening to demand for coil sections exceeding 80 feet in length (the maximum span for the elongation jaws) since the visible surface imperfections are being avoided. So, the maximum length of an unblemished section is now only determined by the length of the coil itself, and, as noted, these routinely exceed 2,000 feet before being subjected to the elongation step which can add another 1% to the length of the shipped product.

While presently preferred embodiments of the invention have been shown and described in particularity, it may be otherwise embodied within the scope of the appended claims.

What is claimed is:

1. A method for producing a stretcher leveler gripping means capable of withstanding forces necessary to stretcher level metal comprising the steps of:

providing a support member made of steel having a support surface and a means for installation within a stretcher leveler apparatus.

pouring the polyurethane material onto a support surface of the support member; and allowing the material to solidify on the surface such that it bonds thereto;

thereby forming a polyurethane surface on the support member so that the polyurethane surface acts to grip the metal being stretcher leveled within the stretcher leveler apparatus.

2. A method as described in claim 1 including before the pouring step the step of heating a polyurethane material such that it liquifies.

3. A method as described in claim 2 including before the heating step the step of cleaning the surface.

4. A method as described in claim 3 including after the cleaning step the step of applying adhesive to the surface.

5. A method as described in claim 4 wherein the cleaning step includes the step of sandblasting the surface.

6. A method as described in claim 5 wherein the adhesive is thixon based.

7. A method as described in claim 6 wherein the pouring step occurs essentially in a vacuum.

8. A method as described in claim 7 wherein the polyurethane material is a polyurethane elastomer.

9. A method as described in claim 1 including after the allowing step, there is the step of attaching the support member to the stretcher leveler such that the material grips metal to be stretched during operation of the stretcher leveler.

10. A method for producing a stretcher leveler gripping means capable of withstanding forces necessary to stretcher level metal comprising the steps of:

providing a support member made of steel having a support surface and a means for installation within a stretcher leveleer apparatus;

cleaning the support surface of the support member; and casting, in situ, a polyurethane gripping surface on the support surface;

thereby forming a polyurethane surface on the support member so that the polyurethane surface acts to grip the metal being stretcher leveled within the stretcher leveler apparatus.

11. A method as described in claim 10 including before the casting step the step of applying adhesive to the support surface.

12. A method as described in claim 11 including before the cleaning step the step of placing grooves in the support surface of the support member such that a greater surface area of the support surface is presented to the polyurethane gripping surface to which it can anchor during casting.

13. A method as described in claim 12 wherein the grooves are placed in the support surface such that the grooves are perpendicular to the direction metal is stretched by the stretcher leveler.

14. A method as described in claim 12 wherein the casting step occurs essentially in a vacuum.

15. A method as described in claim 14 wherein the polyurethane material is a polyurethane elastomer.

16. A method as described in claim 10 including after the allowing step, there is the step of attaching the support member to the stretcher leveler such that the material grips metal to be stretched during operation of the stretcher leveler.

* * * * *

UNITED STATES PATENT AND TRADEMARK OFFICE

CERTIFICATE OF CORRECTION

PATENT NO. : 5,077,887

DATED : January 7, 1992

INVENTOR(S) : Bertram A. Holloway

It is certified that error appears in the above-identified patent and that said Letters Patent is hereby corrected as shown below:

Column 5,line 7, delete "the".

Column 5, line 7, change "a" to -- the --.

Column 6, line 6, change "leveleer" to -- leveler --.

Signed and Sealed this

Twenty-second Day of June, 1993

*Attest:*

Michael K. Kirk

MICHAEL K. KIRK

*Attesting Officer*

*Acting Commissioner of Patents and Trademarks*